United States Patent [19]

Fullbright et al.

[11] Patent Number: 4,527,403

[45] Date of Patent: Jul. 9, 1985

[54] CIRCULAR KNIT PANTY AND METHOD

[75] Inventors: Olen E. Fullbright, Connellys Spring; Truette H. Baird, Valdese; Jack H. Wade, Morganton, all of N.C.

[73] Assignee: Hosiery Maufacturing Corp. of Morganton, Morganton, N.C.

[21] Appl. No.: 638,294

[22] Filed: Aug. 6, 1984

[51] Int. Cl.[3] ..... A41B 9/00; D04B 9/12; D04B 9/18

[52] U.S. Cl. ..... 66/177; 66/194; 2/401

[58] Field of Search ..... 2/401, 406; 66/176, 66/177, 194; 128/524, 528, 556

[56] References Cited

U.S. PATENT DOCUMENTS

| | | | |
|---|---|---|---|
| 2,193,467 | 3/1940 | Rutledge | 2/401 |
| 2,792,698 | 5/1957 | Hampp | 2/401 X |
| 2,876,779 | 3/1959 | Ebert | 128/528 |
| 3,208,242 | 9/1965 | Fors | 66/177 |
| 3,985,004 | 10/1976 | Johnson et al. | 66/177 |
| 4,048,819 | 9/1977 | Johnson | 66/177 |
| 4,236,257 | 12/1980 | Williams et al. | 2/406 |

*Primary Examiner*—Wm. Carter Reynolds

*Attorney, Agent, or Firm*—Bell, Seltzer, Park & Gibson

[57] ABSTRACT

The present panty is formed of first and second seamless tubular knit blanks each of which includes an inwardly turned welt on one end, a predetermined length of body yarn and inwardly contracted mock rib areas formed by incorporating elastic yarn therein. The inwardly contracted mock rib area of one seamless blank is much longer than the other and is adapted to form the crotch area of the panty. Cotton yarn is incorporated on the inwardly contracted mock rib areas and forms inwardly extending terry loops. The seamless blanks are longitudinally slit and then joined together by a transverse seam extending across and connecting the inwardly contracted mock rib areas and opposite side seams are formed along opposite sides of the body portions of each blank and the inwardly turned welts to complete the panty and join the waistband and form a waist opening.

8 Claims, 9 Drawing Figures

CIRCULAR KNIT PANTY AND METHOD

FIELD OF THE INVENTION

This invention relates generally to a circular knit panty and method of forming the panty, and more particularly to the formation of such a panty from a pair of circular knit blanks with identical turned welts on one end and contracted fabric areas on the other end so that both the front and rear portions of the waistband include an inwardly turned welt of identical construction, and increased fabric density is provided in the panty crotch area.

BACKGROUND OF THE INVENTION

It is well known to form knitted panties or briefs from circular knit blanks For example, U.S. Pat. No. 3,375,530 discloses the formation of a panty garment from a single tubular blank continuously knit from one end to the other and being of the same diameter throughout its length. A semi-circular cutout is then formed in one side of the medial portion of the tubular blank and walewise slits are formed above and below the cutout to form a flat blank with the central crotch area being reduced in width. The flat blank is folded in half and the slit edges at opposite sides are sewn together to complete the panty with the front and rear portions of the waistband being knit in opposite directions in the finished garment. The knitting of the front and rear portions of the waistband portions in opposite directions imparts a different appearance to the front and rear waistband portions and the terminal end portion of the last-knit waistband portion has a tendency to unravel.

British Pat. No. 1,328,276 discloses two different types of panties formed of circular knit blanks. The panty of FIGS. 1–6 is formed of two separately knit circular blanks of the same length. These blanks are longitudinally slit and joined along opposite side edges to form joined-together front and rear panels. The lower end portions of the joined-together panels are then cut along curved lines to form leg openings and finally the lower ends of the front and rear panels are connected to each other by a separate gusset with transverse seams extending across the front and rear of the crotch area. The form of panty illustrated in FIGS. 7–9 is substantially identical to the panty of U.S. Pat. No. 3,375,530, discussed above.

U.S. Pat. Nos. 3,985,004 and 4,048,819 disclose the formation of a panty garment from a single circular knit tubular blank, the central portion of the blank is knit with elastic yarn incorporated therein to contract and draw the same inwardly into an hourglass configuration and to provide increased fabric density in the crotch area. The circular blank is then slit in a walewise direction and transversely folded, and the opposite slit edges of the upper portions adjacent the waistband are stitched together to form the panty portion. However, the panty of these two patents is formed of a single-piece seamless blank which includes a turned welt at each end of the seamless blank. The turned welts on opposite ends of the blank are knit in opposite directions so that the completed panty has the same disadvantages as the panty of U.S. Pat. No. 3,375,530, discussed above.

SUMMARY OF THE INVENTION

With the foregoing in mind, it is an object of the present invention to provide a panty and method of forming the same from a pair of circular knit blanks with each blank including identical turned welts on one end and contracted fabric areas on the other end so that the panty is provided with front and rear waistband portions of identical construction, and increased fabric density in the panty crotch area.

The panty is formed by knitting a first seamless tubular blank while initially forming an inwardly turned welt and then knitting a predetermined length with a relatively short inwardly contracted crotch area portion at the lower end thereof. A second seamless tubular blank is knit while initially forming an inwardly turned welt in an identical manner to the inwardly turned welt on the first blank and then knitting a predetermined length with a relatively long inwardly contracted crotch area portion at the lower end thereof. The inwardly contracted crotch area portions of each blank are formed by incorporating elastic yarn in spaced-apart wales to form mock ribs therein. The two blanks are then longitudinally slit and seamed together along portions of the opposite slit edges and the inwardly contracted lower ends are connected by a transverse seam line to form a narrow crotch area and leg openings.

In accordance with the present invention, the panty includes a waistband in which the front and rear portions are formed of identical inwardly turned welts and in which a transverse seam is provided to connect the inwardly contracted crotch area portions to the adjacent panty panels. The mock ribs in the crotch area portions provide increased fabric density. Further fabric density and absorbency is provided by forming terry loops of an absorbent yarn, such as cotton, in the crotch area. The inwardly contracted side edges surrounding the leg openings are finished by the addition of an elasticized lace band or tape sewn thereto.

DESCRIPTION OF THE ILLUSTRATED EMBODIMENT

Other objects and advantages will appear as the description proceeds when taken in connection with the accompanying drawings, in which FIG. 1 is a perspective view of one of the seamless blanks used in forming the panty;

DESCRIPTION OF THE ILLUSTRATED EMBODIMENT

Figure 1:
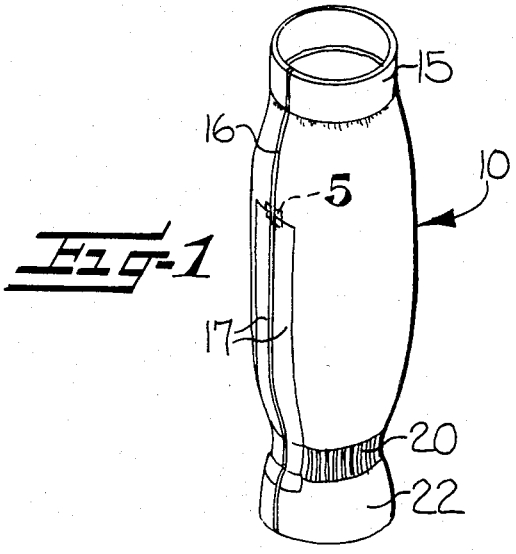
Figure 2:
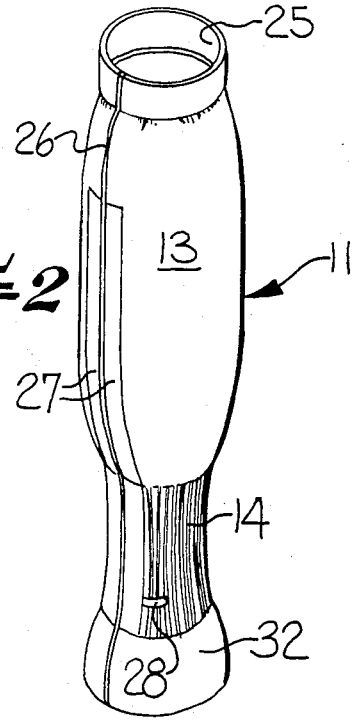
FIG. 2 is a view similar to FIG. 1 but illustrating the second seamless knit blank used in forming the panty.

The panty of the present invention is formed of two circular seamless blanks, of the type broadly indicated at 10 and 11 in FIGS. 1 and 2. The seamless blank 10 is adapted to form the front panel 12 of the panty while the seamless blank 11 is adapted to form the rear panel 13 and the crotch area 14 of the panty.

The seamless blank 10 is knit on a circular hosiery knitting machine, preferably of the type having four yarn feeding and knitting stations. After knitting the makeup in the usual manner, alternate stitch loops are held on transfer points in the dial to knit an inwardly turned welt 15. During the knitting of the inwardly turned welt 15, elastic yarn is incorporated in selected courses to provide elasticity and stretchability to the inwardly turned welt 15. After the desired number of courses are knit in the welt 15, the held stitch loops are transferred back to the cylinder needles in the usual manner and succesive courses are knit of a synthetic textured body yarn, such as 70/34 denier stretch nylon, indicated at B in FIG. 5, with each of the successive courses including adjacent wales of plain stitch loops to form a seamless tube of a predetermined length.

Figure 5:
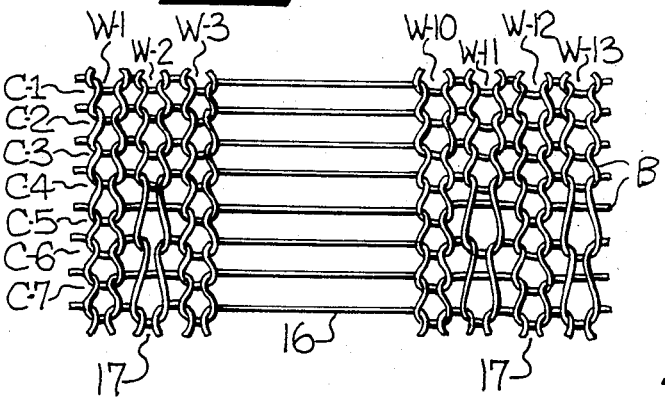
FIG. 5 is a greatly enlarged view showing the stitch structure in the fragmentary area of the blank of FIG. 1 enclosed by the dotted rectangle 5.

During the knitting of the inwardly turned welt 15 and the plain knit circular courses of the body yarn B, a selected group of adjacent needles, preferably six needles, remain in inactive or nonknitting position so that a very wide sinker wale is formed down one side of the seamless blank 10, as illustrated in the central portion of FIG. 5. This wide wale of floated body yarn B is indicated at 16 in FIGS. 1 and 5 and serves as a guide for slitting the seamless blank 10 in a walewise direction after completion of the knitting of the seamless blank 10. After approximately one-third of the plain courses of the front panel 12 have been knit, guide indicator panels 17 of approximately 24 wales wide, are formed at opposite sides of the wide wale 16, as indicated in courses C-4 through C-7 of FIG. 5. In the knitting of these panels 17, the body yarn B is knit in every wale in the alternate courses C-4 and C-6 at opposite sides of the wide wale 16 and knit in every other wale of the intervening courses C-5 and C-7 while forming floats of the body yarn B in wales W-2, W-11 and W-13.

Upon completion of the desired number of courses to form the front panel 12, elastic yarn is incorporated in spaced wales of spaced courses to form a relatively short inwardly contracted mock rib area 20, in a manner to be presently described. While the width of the mock rib area 20 may be varied, it is preferred that this area be approximately one-half inch wide. Additional plain knit courses of the body yarn B are then knit to form a lower terminal end portion 22.

The seamless blank 11 (FIG. 2) is knit by first forming an inwardly turned welt 25 which is identical to the welt 15 of the seamless blank 10. A predetermined length of plain fabric is knit of the body yarn B to form the rear panel 13. During the knitting of the welt 25 and the rear panel 13, a wide wale slit indicating line 26 is formed along one side of the blank 11. Indicator panels 27 are also provided adjacent opposite sides of the wide wale slit indicating line 26 in the same manner as described in the knitting of the blank 10. Elastic yarn is incorporated with the body yarn B while forming the relatively long inwardly contracted mock rib crotch area 14, in a manner to be presently described. When knitting the mock rib crotch area 14, it is preferred that relatively narrow indicator panels 28 be formed adjacent the indicator panels 27 and adjacent the lower end of the crotch area 14, for purposes to be presently described. After completion of the knitting of the desired number of courses to knit the proper length of mock rib crotch area 14, circular plain courses of the body yarn B are knit to form a lower terminal end portion 32.

Figure 3:
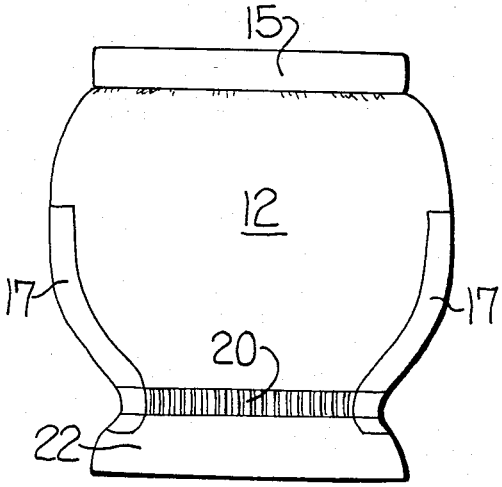
FIG. 3 is a view of the seamless blank of FIG. 1 after it has been slit in a walewise direction and laid out in a flat condition.
Figure 4:
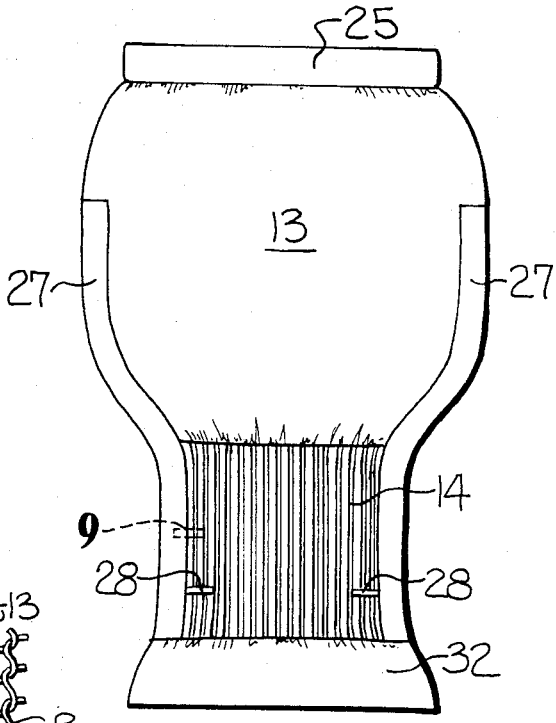
FIG. 4 is a view of the seamless blank of FIG. 2 after it has been slit in a walewise direction and laid out in a flat condition.
Figure 6:
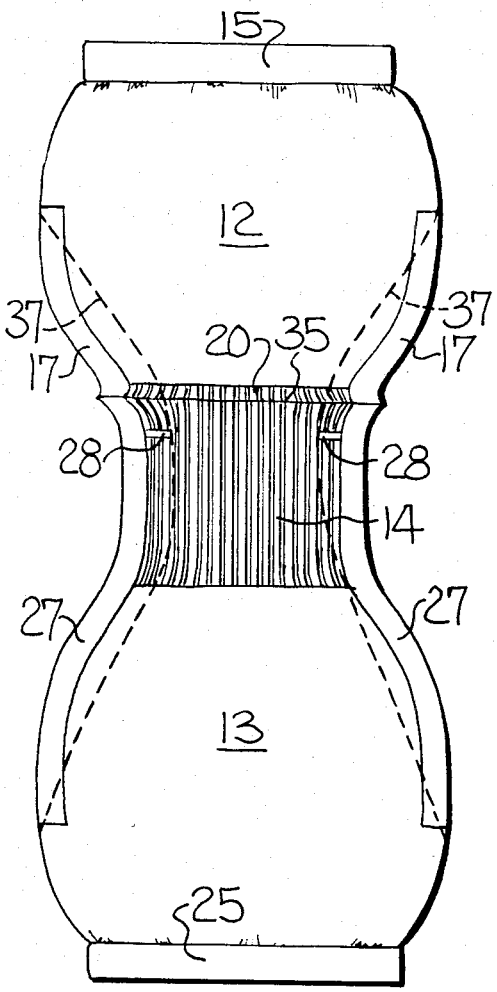
FIG. 6 is a view of the panty blank with the lower end portions of the blanks of FIGS. 3 and 4 being transversely seamed together.

The seamless blanks 10, 11 are then slit in a walewise direction along the respective slit indicating wide wale lines 16, 26 and flattened out to provide the front panel 12 (FIG. 3), rear panel 13, and the integrally knit crotch area 14, as illustrated in FIG. 4. A transverse overedge seam 35 is then formed to connect together the proximal end portions of the inwardly contracted mock rib areas 14, 20 while trimming away the terminal end portions 22, 32 of the blanks 10, 11, as illustrated in FIG. 6. The transverse seam 35 connects together the front panel 12 and the crotch area 14 integrally knit with the rear panel 13 to form a single elongate blank with the identical inwardly turned welts 15, 25 at opposite ends thereof.

Figure 7:
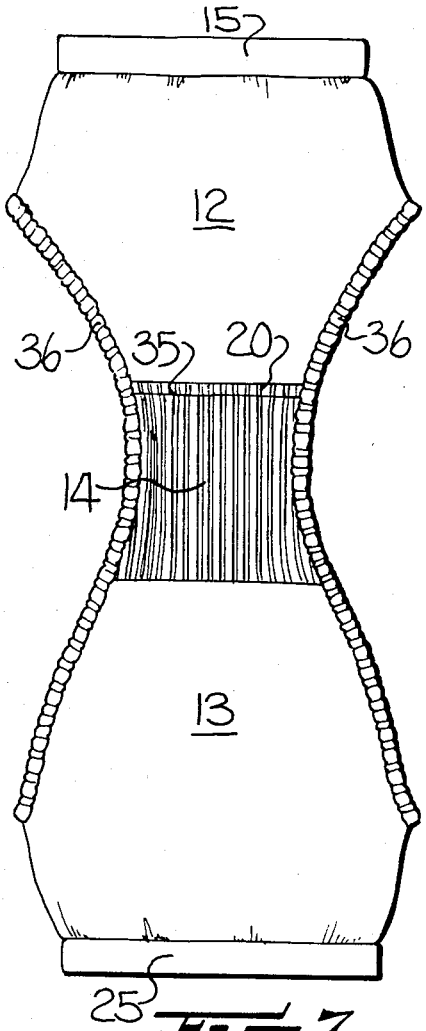
FIG. 7 is a view similar to FIG. 6 and showing the manner in which elasticized lace tape is attached to the opposite sides of the panty blank to surround the leg openings.
Figure 8:
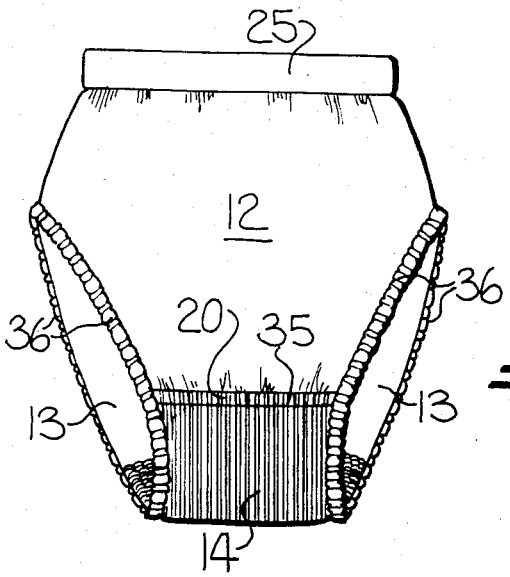
FIG. 8 illustrates the blank of FIG. 7 being transversely folded and with the opposite side edges of the front and rear panels being stitched together to complete the panty.

Opposite side portions of the elongate blank of FIG. 6 are then cut and bound to impart a substantially hourglass configuration thereto. Elasticized tape or lace, indicated at 36 in FIG. 7, is preferably sewn to the opposite edge portions of the elongate blank as it is cut along the dotted lines 37 in FIG. 6. As shown in FIG. 6, the elasticized lace 36 is attached beginning at the upper end of the indicator panels 17 and curves inwardly to a point inside of the indicator panel 28 and then terminates at the lower end of the indicator panel 27.

The rear panel 13 of the single elongate blank of FIG. 7 is then folded upwardly behind the front panel 12 and opposite side edge portions are seamed together to secure opposite ends of the inwardly turned welts 15, 25 and opposite side portions of the front and rear panels 12, 13 and to complete the formation of the panty. It is preferred that the side portions be sewn together with an overedge seam and that the overedge seam be positioned on the inside of the panty.

Thus, the panty of the present invention includes a front panel 12 with successive courses extending between opposite side edges and including adjacent wales of stitch loops formed of a body yarn B. A rear panel 13 also includes successive courses extending between the side edges and including adjacent wales of stitch loops of body yarn B. Identical inwardly turned welts 15, 25 are provided on one end of each of the respective front and rear panels 12, 13 and side seams connect corresponding portions of opposed sides of the front and rear panels 12, 13 and opposite ends of the inwardly turned welts 15, 25. A mock rib crotch area 14 extends between the front and rear panels and is integrally knit at one end to the lower end of the rear panel 13. The crotch area 14 includes inwardly contracted mock ribs with an elastic yarn incorporated therein in spaced-apart wales and floating inside of the wales between the spaced-apart wales to provide greater coursewise stretchability and greater fabric density in the crotch area 14 than the coursewise stretchability and fabric density in the plain knit front and rear panels 12, 13.

Figure 9:
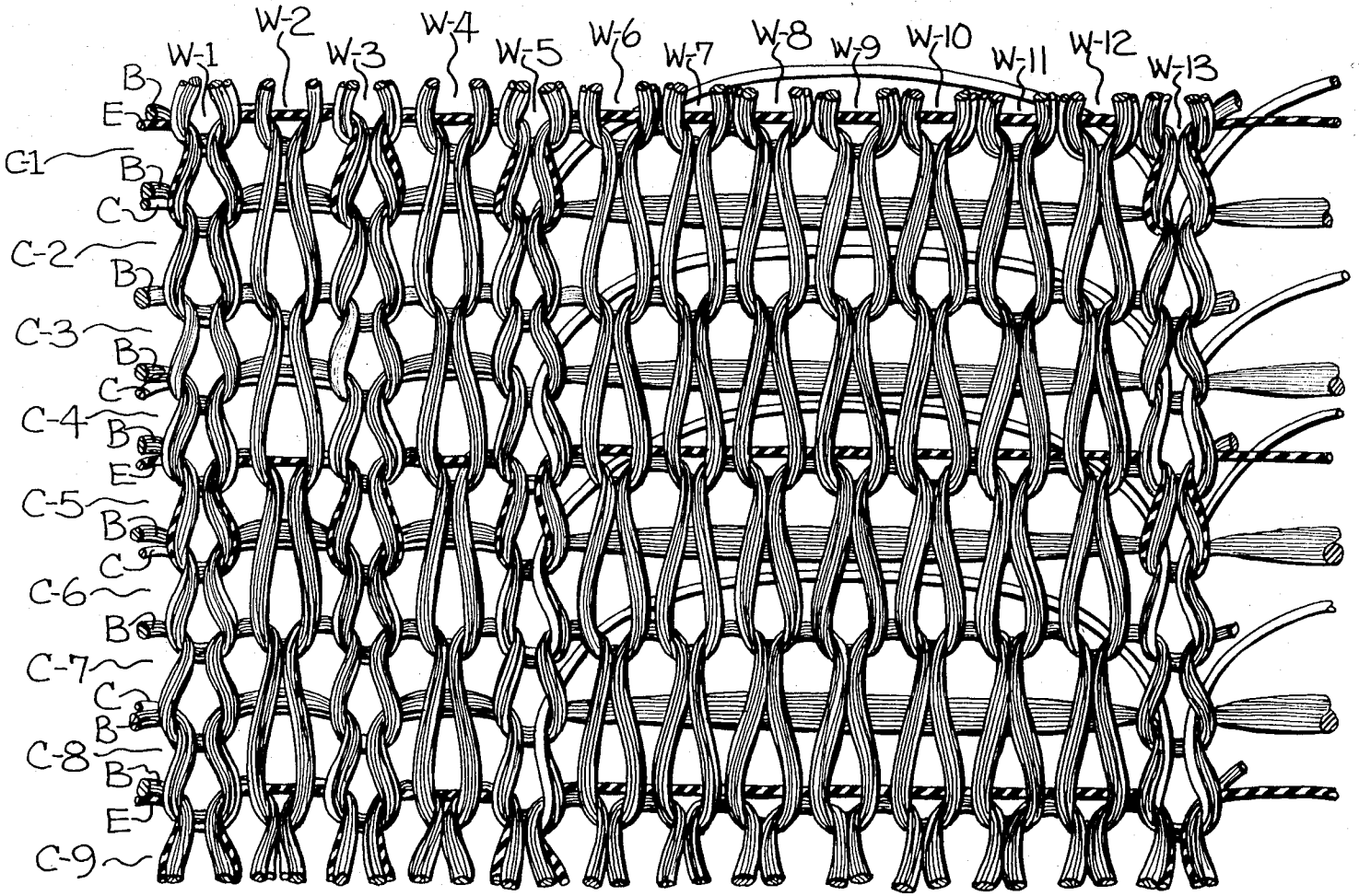
FIG. 9 is a greatly enlarged view of the stitch structure in the crotch area and being taken substantially in the area of the dotted rectangle 9 in FIG. 4.

While a preferred type of stitch structure is illustrated in FIG. 9 for forming the inwardly contracted mock rib crotch area 14 and the adjacent indicator panels 27, it is to be understood that the elastic yarn may be incorporated with the body yarn in other arrangements to form the inwardly contracted mock rib area. FIG. 9 illustrates a portion of the indicator panel 27 in wales W-7 through W-4 and an adjacent portion of the mock rib crotch area 14 in the wales W-5 through W-13. As has been stated, it is preferred that the blanks 10, 11 be knit on a circular hosiery knitting machine including four yarn feeding and knitting stations and the knitting of the stitch structure illustrated in FIG. 9 will be described when knit on this type of machine. However, it is to be understood that the seamless blanks 10, 11 could be knit on other types of circular knitting machines.

Courses C-1, C-5 and C-9 are knit at one of the knitting stations by feeding the body yarn B, comprising 70-denier, 34-filament textured nylon, to all needles and forming stitch loops therewith, except the six inactive needles in the area of the slit indicator line 17 (26). An elastic yarn E, striped for ease of identification, is fed to and forms stitch loops in plated relationship with the body yarn B in alternate wales of the indicator panels 17, 27, as illustrated in wales W-1, W-3 and W-5 while forming floats in the intervening needle wales, as indicated in wales W-2 and W-4. The elastic yarn also floats inside of the needles which form the stitch loops of the body yarn in wales W-6 through W-12 so that a long float of the elastic yarn E is formed inside of the seven wales between the spaced-apart wales W-5 and W-13.

In the courses C-2 and C-6, a cotton yarn C is fed with the body yarn B and forms plated yarn plain stitch loops in wales W-1, W-3 and W-5, and both yarns float across wales W-2 and W-4 of the indicator panels 17, 27. The cotton yarn C forms terry loops extending inwardly inside of the wales W-6 through W-12 and the body yarn B forms an elongate float extending inside of these wales. In courses C-3 and C-7, the body yarn B is fed to all needles and forms plain stitch loops in all of the wales W1 through W-13. Courses C-4 and C-8 are knit with the body yarn B and the cotton yarn C with both yarns being knit together to form plated plain stitch loops in wales W-1, W-3 and W-5 while floats are formed across the wales W-2 and W-4. In the inwardly contracted mock-rib area 14 and 20, the cotton yarn C forms inwardly extending terry loops inside of the wales W-6 through W-12 while the body yarn B forms floats extending inside of the spaced-apart wales in which both yarns are knit in plated relationship, that is, wales W-5 and W-13. Thus, the elastic yarn E floated inside of the seven adjacent wales in spaced-apart courses, courses C-1, C-5 and C-9, as well as the floats of the stretchable body yarn B floating inside of the seven wales, cause the wales W-5 and W-13 to be drawn together coursewise and form the mock ribs. At the same time, this inward drawing of these wales causes the terry loops formed of the cotton yarn C to extend inwardly of the crotch area of the panty.

In the drawings and specification there has been set forth the best mode presently contemplated for the practice of the present invention, and although specific terms are employed, they are used in a generic and descriptive sense only, and not for purposes of limitation, the scope of the invention being defined in the claims.

That which is claimed is:

1. A knit panty comprising a front panel including opposite side edges with successive courses extending between said opposite side edges and including adjacent wales of stitch loops, a rear panel including opposite side edges with successive courses extending between said side edges and including adjacent wales of stitch loops, identical inwardly turned welts on one end of each of said front and rear panels, side seams connecting corresponding portions of said opposite sides of said front and rear panels adjacent said inwardly turned welts and forming a body portion with an upper waist opening defined by said identical inwardly turned welts on the corresponding ends of said front and rear panels, a crotch area extending between and interconnecting said front and rear panels, said crotch area including mock ribs having elastic yarn incorporated in spaced-apart wales and floating inside of the wales between said spaced-apart wales to provide greater coursewise stretchability and greater fabric density in said crotch area than the coursewise stretchability and fabric density of said front and rear panels.

2. A knit panty according to claim 1 wherein said crotch area is integrally knit at one end to one of said front and rear panels, and including a transverse seam extending across said crotch area and connecting said front and rear panels in said crotch area.

3. A knit panty according to claim 2 wherein said crotch area is integrally knit at one end to said rear panel.

4. A knit panty according to claim 1 wherein said front and rear panels are knit of a body yarn comprising multiple filament textured synthetic yarn.

5. A knit panty according to claim 1 wherein said elastic yarn is incorporated in every eighth wale of every fourth course of said crotch area.

6. A knit panty according to claim 5 wherein said elastic yarn is incorporated in said crotch area by knitting the same in plated relationship with said body yarn in said spaced-apart wales.

7. A knit panty according to claim 1 including a cotton yarn incorporated in said crotch area and forming inwardly extending terry loops thereof.

8. A knit panty comprising a front panel including opposite side edges with successive courses of stretchable body yarn extending between said opposite side edges and including adjacent wales of stitch loops, a rear panel including opposite side edges with successive courses of stretchable body yarn extending between said side edges and including adjacent wales of stitch loops, identical inwardly turned welts on one end of each of said front and rear panels, side seams connecting corresponding portions of said opposite sides of said front and rear panels adjacent said inwardly turned welts and forming a body portion with an upper waist opening defined by said identical inwardly turned welts on the corresponding ends of said front and rear panels, a crotch area with successive courses of stretchable body yarn extending between and integrally knit at one end to said rear panel, and a transverse seam extending across said crotch area and connecting said front and rear panels adjacent the other end of said crotch area, said crotch area including mock ribs having elastic yarn knit with said body yarn in spaced-apart wales of spaced-apart courses and floating inside of the wales between said spaced-apart wales to provide greater coursewise stretchability and greater fabric density in said crotch area than the coursewise stretchability and fabric density of said front and rear panels, and a cotton yarn knit with said body yarn in spaced-apart wales of spaced-apart courses and forming inwardly extending terry loops in said crotch area.

* * * * *